United States Patent [19]

Shaw

[11] 4,294,449

[45] Oct. 13, 1981

[54] AMUSEMENT DEVICE

[76] Inventor: James K. Shaw, 4916 Erie St., Annandale, Va. 22003

[21] Appl. No.: 950,966

[22] Filed: Oct. 13, 1978

[51] Int. Cl.[3] ..... A63F 3/00

[52] U.S. Cl. ..... 273/126 R; 273/5 R; 273/3 A

[58] Field of Search ..... 273/2, 5 R, 6, 22, 3 C, 273/3 A, 12, 59 R, 123 R, 127 B, 126 R, 108 R, 118 R, 85 R, 3 R

[56] References Cited

U.S. PATENT DOCUMENTS

| | | | |
|---|---|---|---|
| 458,516 | 8/1891 | Bullen | 273/3 R |
| 669,374 | 3/1901 | Tarbet | 273/123 R |
| 687,989 | 12/1901 | Kelly | 273/123 R |
| 951,805 | 3/1910 | Elridge | 273/126 R |
| 959,985 | 5/1910 | Wright | 273/123 R |
| 1,666,474 | 4/1928 | Sorell | 273/108 |
| 1,875,198 | 8/1932 | Nagai | 273/3 A |
| 1,962,576 | 6/1934 | Jurgen et al. | 273/126 R |
| 3,399,890 | 9/1968 | Galedridge | 273/6 |
| 3,653,665 | 4/1972 | Wahlberg | 273/3 A |
| 3,743,287 | 7/1973 | Liermann | 273/5 B |
| 3,941,378 | 3/1976 | Bagley | 273/5 R |
| 3,988,021 | 10/1976 | Grover | 273/3 C |
| 4,004,804 | 1/1977 | Gholson | 273/6 |
| 4,146,228 | 3/1979 | Laciste | 273/126 R |

FOREIGN PATENT DOCUMENTS 963206 12/1949 France ..... 273/3 C

*Primary Examiner*—Richard C. Pinkham
*Assistant Examiner*—T. Brown
*Attorney, Agent, or Firm*—Israel Gopstein

[57] ABSTRACT

A game table is disclosed for use by one or more players in conjunction with a plurality of playing pieces, including one or more playing pieces and a cue piece associated with each player. The table is further used in conjunction with a cue stick for impacting the cue piece. A provision is made on the playing surface for determination of primacy of play, and receptacles are provided for receiving the pieces of at least one player therein. The receptacles further provide a position for locating the playing pieces associated with the players, as well as for the cue pieces of the players. The playing surface is provided with indicia for locating the remainder of the pieces associated with the players. The playing surface is substantially planar and is atop a playing table, which may have adjustable height. The playing surface and table may have a rhomboid or a lozenge shape. The playing pieces may be substantially disc-like, although balls may also be used. Each player's pieces are coded, preferably by color, to identify the player.

7 Claims, 9 Drawing Figures

FIG. 1
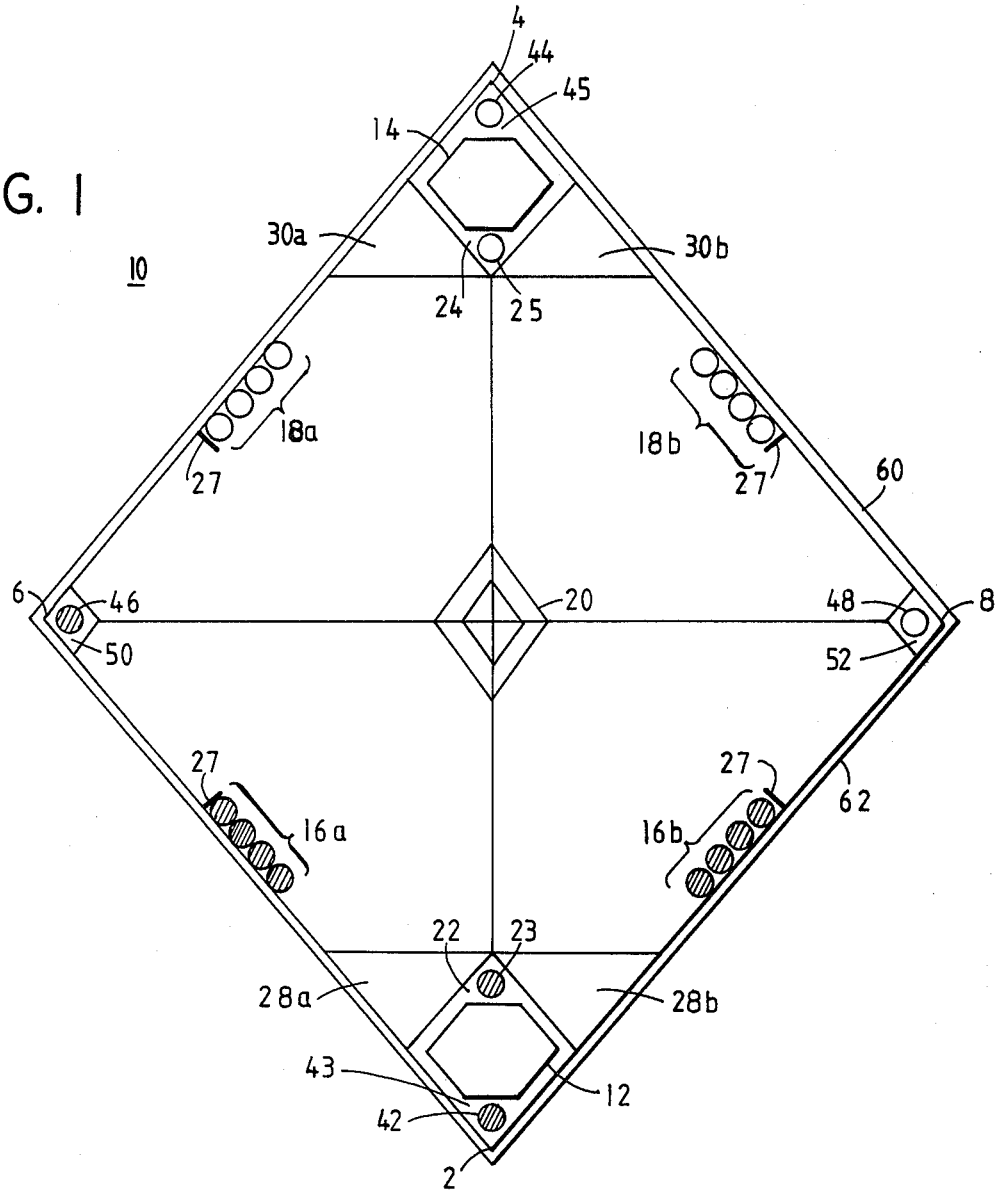
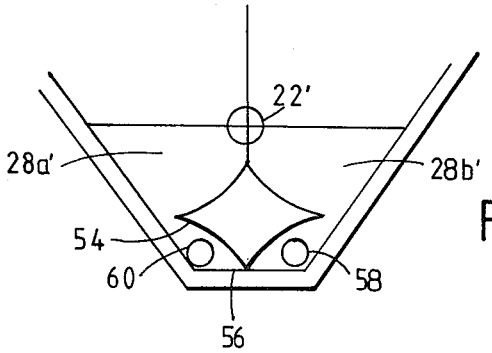
FIG. 2A

AMUSEMENT DEVICE

BACKGROUND OF THE INVENTION (1) Field of the Invention

The present invention relates to gaming devices, and more specifically to devices having some characteristics in common with pool games. The invention further relates to game tables convertible for multiple purpose uses.

(2) Description of the Prior Art

Prior art pool tables and games are known. Modifications of such games are similarly known, as disclosed in Gholson U.S. Pat. No. 4,004,804, for example. Gholson, however, provides an overlay for a pool table, blocking out several of the pockets and providing for usage of others of the pool table pockets. The '804 apparatus provides balls for each player, the numbered balls being required to be hit sequentially by a cue ball after impact by a cue stick. A special area is provided for shooting the cue ball, and a cruciform arrangement utilized for initially racking the balls in the center of the playing surface.

Sorell U.S. Pat. No. 1,666,474 discloses a playing table wherein playing pieces are placed on specific character positions on the board and a finger toss utilized in playing the game.

Adjustable and convertible game tables are disclosed in Bagley U.S. Pat. No. 3,941,378 and Grover U.S. Pat. No. 3,988,021, while a diamond-shaped playing table is provided in Galedrige U.S. Pat. No. 3,399,890, having an ornamental center design and a cruciform racking of the pieces, as well as a pocket at each corner of the table.

A game played in The Peoples Republic of China has four holes at the corners of a square table, and a piece is located behind each hole, at the corner of the table. A penalty area is provided at the center of the table. The game is played by four people only. No rules are provided with respect to permissible targets nor are any special areas designated as locations from which to shoot. No penalty is provided for having a piece fall from the table. Primacy of play is determined by luck, or by choosing among the players. Players located diagonally across the playing table from each other are partners. In structure, this game provides vertical table walls having a lip which overhangs the playing area, and uses a cue piece differently sized from the remaining pieces. The pieces are formed of spherical cross sections, and cannot be made to roll from one player to another. The cue pieces further do not have a means for retrieving the same, and since they cannot be rolled from one player to another, provide difficulty in attempts to return such a piece to a player.

SUMMARY AND OBJECTS OF THE INVENTION

It is an object of the present invention to provide an amusement device for playing a more challenging game than that disclosed in the prior art.

It is a further object of the present invention to provide a game-playing apparatus including a means for determination of primacy of play.

Yet a further object of the invention is to provide a gaming table having positioning means thereon for the various pieces utilized by the players, without requiring the use of a special racking apparatus.

Yet another object of the invention is the provision of a game table for play by from one to four players having positioning means for the cue pieces thereon for shooting said cue pieces at other pieces on the table with the aid of a cue stick.

Yet another object of the invention is the provision of a gaming table having receptacles or pockets at two corners thereof.

Another object of the invention is the provision of a gaming table having positioning means at corners thereof which do not have pockets therein.

It is yet a further object of the invention to provide a gaming table with positioning means for special pieces at the corners thereof behind the receptacles thereof.

Still another object of the present invention is to provide a gaming table which is of an adjustable height and is usable for one of several games.

An additional object of the invention is to provide a game table capable of serving as a bar, a desk and a cocktail table at varying heights.

Still a further object of the invention is the provision of a game table having adjustable height by utilization of legs comprised of several removable sections.

Still another object of the invention is the provision of a game table having adjustable height using foldable legs therein.

In accordance with these and other objects of the invention, a playing surface is provided on a table, the playing surface being generally rhomboid in shape. The game table provides vertical walls at the circumference of the playing surface. The table includes at two corners thereof, preferably two diagonally opposed corners, receptacles for pieces of the players. Adjacent each of the receptacles is provided a positioning area for a cue piece associated with each player.

The table further includes positioning means, preferably along the sides thereof, for the pieces to be used by the players. Preferably, the positioning means for a player associated with a particular receptacle are provided along the edge of the table having one of its ends associated with the corner containing said receptacle. The gaming table further provides an area at a preselected location on the table, preferably at the center thereof, for determining primacy of play.

Associated with each receptacle is a positioning means for the cue piece of the player associated with that receptacle, as well as a positioning means for a special piece associated with said player. Additionally, positioning means are provided for a second special piece associated with each player. The positioning means for said second special piece may be at the corners not having the receptacles, or, in an alternate embodiment, may also be associated with the player's receptacle.

The positioning means for a cue piece of a particular player may be divided into two areas, and the playing surface associated with each player may similarly be divided into two areas. In accordance with such division, special rules for the utilization of the table may be set up wherein the cue piece must be positioned in one of the two positioning areas in order to attempt to contact a piece of the opposing player in a particular segment of the playing surface.

Finally, the present invention is provided with an adjustable height means, preferably in the form of multiple sectioned legs, the sections being removable, in order to permit the multiple purpose use of the table.

Thus, the gaming table may be used as a bar, a desk, a cocktail table, or a chess table, for example.

These and other objects, features, and advantages of the present invention will become more readily apparent from the following specification and appended claims, when considered in conjunction with the attached drawings.

BRIEF DESCRIPTION OF THE DRAWINGS

FIG. 1 shows a plan view of a game table in accordance with the present invention.

FIG. 2A illustrates in detail a corner of a table according to an alternate embodiment of the invention.

DETAILED DESCRIPTION OF A PREFERRED EMBODIMENT OF THE INVENTION

Figure 2B:
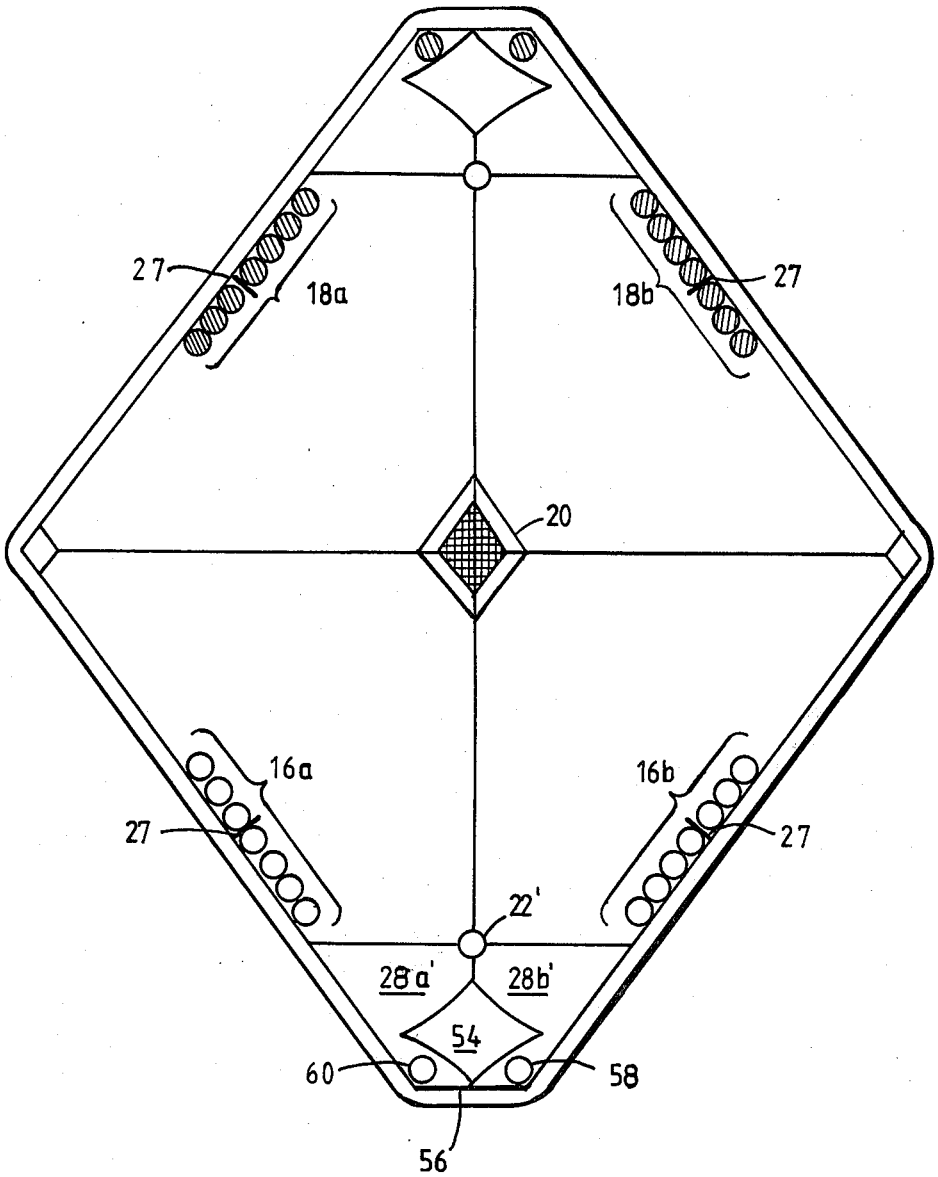
FIG. 2B shows the game table of the alternate embodiment.

As shown in FIG. 1, the playing surface 10 of the present invention is generally rhomboid in shape, having two corners 2 and 4 disposed at terminals of one diagonal of the playing surface. A second pair of corners, 6 and 8, is disposed at terminals of the other diagonal of the rhombus. As shown in the figure, corners 2 and 4 are disposed at the end of the major diagonal of the rhombus, while corners 6 and 8 are at the terminals of the minor diagonal of the rhombus. The playing area is preferably composed of a hard surface, to enable sliding of pieces thereon during play. This advantageously eliminates the need for a special mat in pool tables where rolling pieces are used.

It is appreciated, however, that the table shape may deviate from the generally rhomboid shape shown in FIG. 1. Specifically, by proper selection of the angles at corners 2, 4, 6 and 8, the table top may be square shaped. It is further possible to utilize a rectangularly shaped table without departing from the spirit of the invention. Further, while the subsequent description proceeds with respect to a rhomboid shape, it is conceivable that receptacles 12 and 14 provided at corners 2 and 4, respectively, for receiving therein pieces 16*a*, 16*b*, 18*a* and 18*b*, respectively, might be disposed at the terminals of the minor diagonal of the rhombus. In that event, the pieces identified with a particular player, say 16 for example, would be placed at the table edges meeting at corner 6, for example.

While FIG. 1 shows two sets of pieces, 16 and 18, for play by two players, one set may be omitted for play by a solitary player. The sets may be split into subsets 16*a*, 16*b*, and/or subsets 18*a* and 18*b*, for play by three or four players. In the event that three players use the game, each subset would be increased to provide an appropriate number of pieces for each player, as follows. Sets 16*a*, 16*b* and 18*a* would have seven pieces in each, for example, while set 18*b* would be eliminated. The two players associated with sets 16*a* and 16*b* play in partnership. Play by four players can proceed with two sets of partners, each playing with expanded sets of pieces. While cue pieces may be shared by members of a partnership, the present game provides individual cue pieces for each partner.

Figure 6:
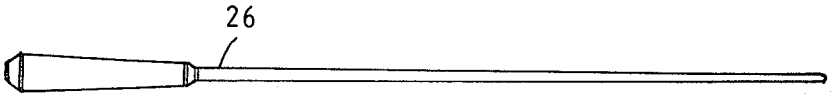
FIG. 6 shows a cue stick as used in the present invention.

A special means 20, in the form of a marking on the table top, is provided at a predetermined location on the playing surface. As shown in FIG. 1, the marking 20 is preferably provided in a central location of the playing surface . However, means 20 may similarly be provided at any desired location on the surface. The marking 20 is utilized to determine primacy of play, in the sense that prior to beginning play each player places a cue piece at a predetermined location. The present invention provides locations 22 and 24, immediately in front of receptacles 12 and 14, for placement of the cue pieces 23 and 25. Each player utilizes a cue stick 26, as shown in FIG. 6, to impact the cue pieces. The present cue stick may be held in a thumb-up position rather than the thumb-down position used in a pool game. The player whose cue piece comes closest to the center of the marking 20 is awarded the first turn in the play of the game as well as choice of identifying indicia, color, or the like. Moreover, if three players are involved, the player with cue piece closest to the marking center may have the choice of playing individually or with a partner. Turns of play then alternate between or among the players. It is understood, of course, that the placement of the cue pieces 23 and 25 need not necessarily be at locations 22 and 24 immediately in front of receptacles 12 and 14 as shown in FIG. 1. These locations may be located elsewhere on the playing surface.

During play of the game, a player places his cue piece in one of predetermined areas 28 or 30, shown in FIG. 1 divided into two triangular areas each, 28*a* and 28*b* and 30*a* and 30*b*, respectively. The cue piece is impacted with cue stick 26, and is aimed at the pieces of the opposing player which have been lined up against the walls of the table containing the playing surface. The pieces are placed at positions determined by positioning means 27, which may be marks on the playing surface, the vertical walls of the table, or the like. The objective of the game is for a player to cause one of his opponent's pieces, which may be called "Jacks" for example, to fall into the opposing player's receptacle. When a first player succeeds in delivering one of his opponent's pieces into the receptacle, the first player retrieves his cue piece from the playing surface (unless it has fallen into the receptacle) and retains it, away from its normal placement location 28 (or 30), awaiting to take another turn. The player may retain the piece in his hand at this time. If a player does not succeed in causing an opponent's piece to fall into the opponent's receptacle, which may be a hole, a cup, or the like, the opponent's piece is left in the position to which it had moved, but the first player's cue piece is returned for subsequent shooting with cue stick 26 from the placement areas 28 or 30 during a later turn. The turn of play in that event reverts to the opponent, who then attempts to achieve the same objective, but with the first player's pieces. In the event that the cue piece, after being impacted, remains within a portion of the player's area 28 or 30, or covers a portion of the lines used to delineate the same, the player may be given another chance to shoot.

The winner of the game is the player who first succeeds in causing all of his opponent's playing pieces to drop into the receptacle. Score may be kept by providing the winner with a number of points equal to the number of his own pieces still remaining on the table, by awarding the winner a fixed number of points, by awarding a number related to the number of strokes needed for placing the pieces in the receptacle, or by awarding a player a point value for each of the opponent's pieces pocketed in the receptacle.

Figure 4A:
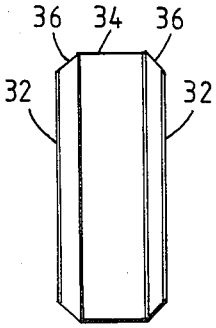
FIGS. 4*a* and 4*b* illustrate side and top views of a playing piece as used in the present invention.
Figure 4B:
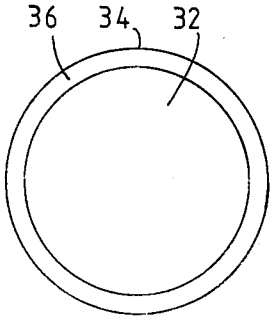

An illustrative playing piece is shown in side and top views in FIGS. 4*a* and 4*b*. The piece is preferably a disc-like object, having a pair of opposing gliding faces 32 of circular shape, and a central cylindrical portion 34 generally used for impact by the narrow tip of cue stick 26. The gliding surfaces may be connected to central portion 34 by tapered surfaces 36, which may each comprise a frustum of a cone.

Figure 5A:
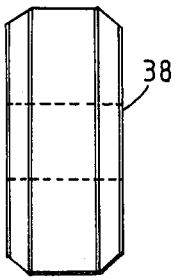
FIGS. 5*a* and 5*b* show side and top views of a cue piece used in conjunction with the present invention.
Figure 5B:
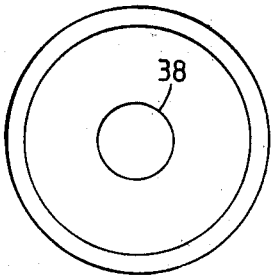

The cue piece, shown in FIGS. 5*a* and 5*b*, is generally similar to a standard piece shown in FIG. 4, but may include a cylindrical opening 38 provided therein. This opening provides a means for retrieving the cue piece by insertion of the cue stick therein when the piece is out of the player's reach. This feature advantageously enables play to proceed along with a rule prohibiting touching of a cue piece except in areas 28, 30. Accordingly, a player may retrieve an opponent's cue piece, and place the same in the central area by hand. From this point the opponent may retrieve the piece by engaging opening 38 with cue stick 26. It is appreciated, of course, that spherical elements may be used as the playing pieces rather than the disc-like objects shown in FIGS. 4 and 5. However, the shape of the elements shown in FIGS. 4 and 5 is selected to provide a sliding rather than a rolling action of the playing elements. Moreover, the cylindrical portion 34 enables one player to return a piece to another player by rolling the same along portion 34 on the playing surface.

The elements used by the individual players may be coded in a predetermined way, such as by the coloration thereof, or by the placement of individual indicia thereon.

In addition to the jacks, each player is further provided with at least one special piece. A king, shown at 42 and 44, is provided to each of the respective players. In FIG. 1 the kings are shown as being placed in placement areas 43 and 45 behind the receptacle and at the individual corners between the walls surrounding the playing surface.

It is an ultimate object of the game to cause the king of the opposing player also to be received in the opponent's receptacle. The game rules, however, permit the cue piece of a first player to fall into the opponent's receptacle without penalty only if the opponent's king was similarly placed in said receptacle by the particular action taken by the first player. The king elements may or may not be specially coded, but their placement is calculated to provide for a difficult operation in attempting to sink the same in the appropriate receptacles. Accordingly, the point value of a pocketed king may exceed that of a jack.

A second special piece, shown at 46 and 48, respectively, may be provided for each player. This piece, called a queen, is shown in FIG. 1 as being placed at the non-receptacle corners of the playing surface, 6 and 8, respectively. Special placing indicators 50 and 52 are shown in the figure as providing the placement boundaries for the queen pieces. While the queens are generally more difficult to attack with a cue element than are the jacks, they are nonetheless easier to pocket than are the king pieces. A point value must be assigned to a pocketed queen which is intermediate the value for a jack and a king. Accordingly, game strategy would dictate first attempting to sink all of the jacks of a player, then the queen and finally the king.

FIGS. 2A and 2B show an alternate embodiment of the invention. While other features are similar to FIG. 1, FIG. 2A illustrates a modified corner of the playing surface. A receptacle 54 is shown in the "broadened" corner 56. The receptacle in this embodiment and the areas defined thereby are utilized to provide placement for both a queen and a king piece, shown at 58 and 60, respectively. The receptacle is still used to define a shooting area 28*a*′ and 28*b*′, and a placement marker may still be provided at 22′ for initial determination of primacy of play.

FIG. 2B shows an entire playing surface using the corner shown in FIG. 2A, and includes the marking 20 as well as the jacks used by the players. The jacks are shown on both sides of marks 27, unlike the embodiment of FIG. 1.

Figure 3:
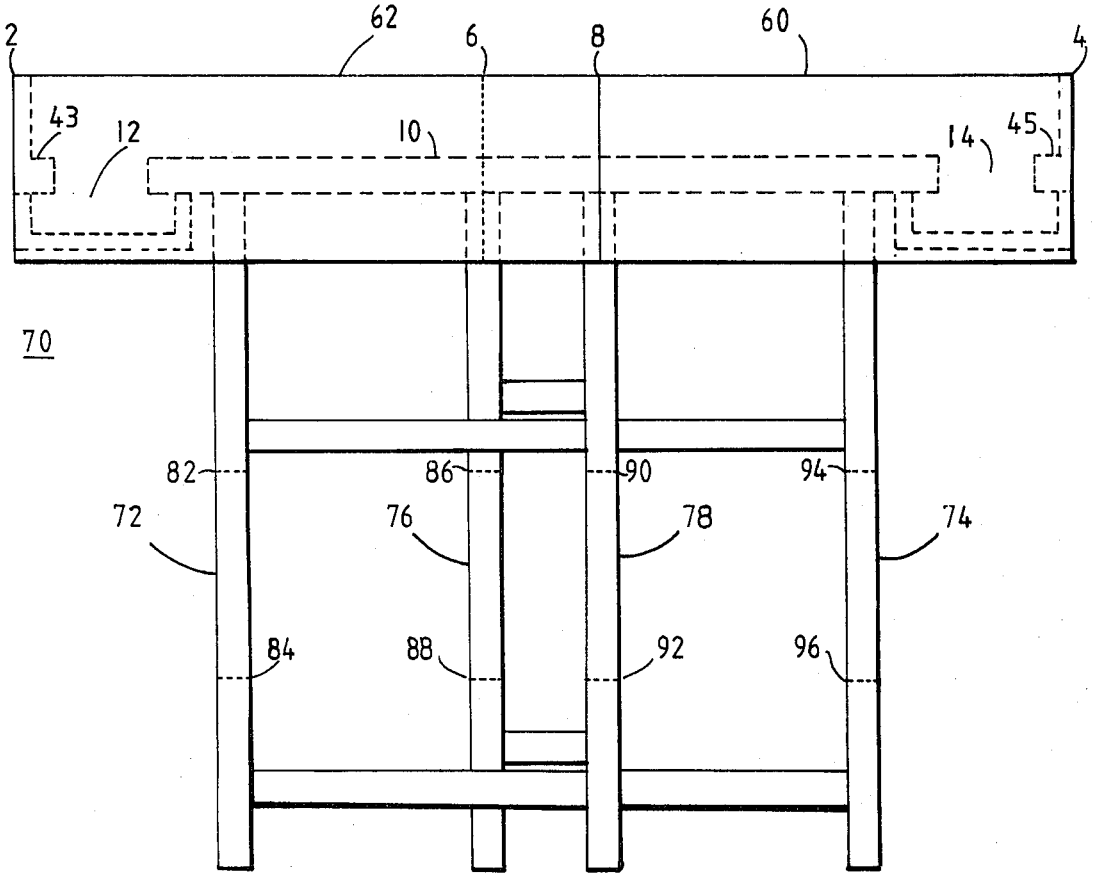
FIG. 3 shows a side view of the table according to the present invention.

Referring now to FIG. 3, playing surface 10 is shown in dashed line as surrounded by vertical portions of the game table. Two of the walls are shown at 60 and 62. Receptables 12 and 14 are shown at the corners 2 and 4 formed by walls 60 and 62 with their corresponding opposite walls, not shown herein. Additionally, a support structure is shown generally at 70, and comprises legs 72, 74, 76 and 78. The legs may be composed of a plurality of detachable sections, as shown by the dotted lines 82, 84, 86, 88, 90, 92, 94, and 96. By detaching and connecting the various leg segments at the dotted lines, the table height may be altered to provide either a bar, a chess table, a game table or a cocktail table, for example.

The various elements of the game table and the other components previously described are combined in playing the game as follows.

Initially, cue pieces are placed on the placement means 22 and 24 in front of the player's receptacles 12 and 14, and aimed at the special means 20, shown as a diamond-shaped mark. The player placing his cue piece most centrally in the diamond obtains the primary playing turn and proceeds first. Upon taking his turn, the player places his cue pice in one of the placement triangles 28*a* or 28*b*, for example, adjacent the receptacle 12 on his side, and aimed at the balls or pieces 18 of the opposing player on the diagonally opposite quadrant of the board. Play proceeds with both sides alternating shots. Each player attempts to place the playing pieces of the other player into the other player's pocket receptacle. If an opponent's piece, hit by the cue piece, is not pocketed but is instead moved into the central playing area of the board, the opposing player may move that piece by hitting it with his own cue piece upon taking his turn.

Although the description refers to a cue piece in association with each player, clearly a single cue piece may be shared by more than one player.

If a first player inadvertently causes his opponent's ball or piece to land in the first player's receptacle, the first player must remove the same from the pocket and replace it in the original location against the wall, as determined by positioning means 27. No points are scored in that event. If a player causes one of his own pieces to enter his own or the opposing player's pocket, it is treated as a piece successfully pocketed by the opponent and accrues to the opponent's score.

In the event that a player's cue piece is pocketed in either receptacle, a penalty is assessed wherein an additional one of the opponent's pieces is removed from a pocket and replaced on the table, adjacent positioning means 27. If a player's cue piece is dropped from the playing table, the opposing player receives two successive chances to play. However, if the cue pieces drops from the table, but simultaneously a jack or any of the special pieces (queen or king) is pocketed, it is at the player's option to continue to play or to retain the effective score of the pocketed piece.

As play proceeds, each player places his cue piece on one of the placement areas on his side and aims for the appropriate pieces of the opposing player. When one such piece is pocketed in the receptacle, the player continues his turn until he fails to pocket one of the opponent's pieces. At that point, the opponent begins his turn.

Concerning point scoring, the points may be utilized by permitting an additional turns to a player. Alternatively, as previously discussed, points might represent the number of a player's remaining pieces after the player pockets the opponent's king, or completely pockets all of the opponent's pieces. Points might, alternatively, represent the differential in the number of strokes required by the players to pocket all of the opponent's pieces. Winning the game may also be determined by first pocketing all of the opponent's pieces without associating a point value therewith. If the player whose cue piece won primacy is the first to pocket the opponent's king, the opponent may receive another turn to assure all players have an equal number of playing turns. In the event that both players pocket the king on the same turn, the winner may be determined by the resulting location of the cue piece, in the following hierarchy: a player whose cue piece remained on playing table defeats a player whose cue piece fell from the table, and either one defeats a player whose cue piece was pocketed along with the king. In the event that a king or queen piece drops from the table, the piece is replaced in its specially designated position, shown at 43 and 45 for the kings, and 50 and 52 for the queens. A jack which is dropped from the table is replaced in its original position, specifically at the penalty position adjacent one of positioning means 27. The cue piece and the king may be pocketed simultaneously without penalty. However, if the cue piece is pocketed without the king, the cue piece is withdrawn and simultaneously a penalty jack is withdrawn from the opponent's pocket and placed adjacent the penalty positioning means 27 for the jacks of the opposing side. If the cue piece contacts a jack or any other piece which in turn contacts the king, both pieces being pocketed simultaneously, two points are scored by the player. If, however, the cue piece is also pocketed during this turn, the king is replaced in its original position and only one point is scored, for the pocketed jack. This description assumes that points are scored by the number of pieces pocketed by a player. It is of course possible that kings and queens, or any other special pieces which might be utilized, may receive more than one point upon being pocketed. Rules similar to those discussed in the immediately preceding description apply to simultaneous pocketing of a king and queen, or a queen and a jack playing element.

Additional rules of interest relate to the positioning marks 27 placed on the playing surface adjacent the walls of the game table. Upon beginning the game the jacks are placed adjacent thereto. The position immediately adjacent the positioning mark is the placement position for the penalty pieces and pieces dropped from the table. In the event that the position immediately adjacent a mark 27 is occupied, additional pieces are placed, when necessary, in front of the piece presently occupying the location, i.e., in the playing area. A column of such penalty pieces may thus be placed at the positioning mark 27. It is understood that a penalty positioning means separate from positioning mark 27 may be provided.

The playing pieces which, after being hit by the cue piece, are located on the table may not be moved for the purpose of clearing a subsequent turn of the cue piece. The only time such a piece may be moved is in the event that it is located in one of the placement areas adjacent a player's receptacle pocket. Upon completion of a turn, the player retrieves the cue piece and holds it until his next turn. In order to avoid blocking his opponent's access to the player's receptacle, the piece is not replaced in the placement location until it is again the player's turn.

It is appreciated that rules for playing of different games may be implemented utilizing the present apparatus. Such rules would similarly beneficially utilize one or more features of the described apparatus, including the receptacles, placement areas adjacent thereto, positioning means, primacy determining means, cue piece positioning areas, etc.

The preceding specification describes, by way of illustration and not of limitation, a preferred embodiment of the invention. Equivalent variations of the described embodiment will occur to those skilled in the art. Such variations, modifications, and equivalents are within the scope of the invention as recited with greater particularity in the following claims, when interpreted to obtain the benefits of all equivalents to which the invention is fairly entitled.

I claim:

1. A game apparatus comprising: a substantially planar playing surface mounted atop a game table; vertical walls attached to the perimeter of said playing surface; indicia located substantially at the center of said playing surface; said surface having a plurality of corners; some of said corners having indicia and others of said corners having receptacles; the number of said corners being greater than the number of said receptacles, and said receptacles being dimensioned for receiving playing pieces used in conjunction with said game apparatus; a plurality of playing pieces; said playing pieces including separate sets of playing pieces for use by separate players, each of said separate sets of playing pieces having means for distinguishing it from the other sets; each separate set being divided into at least one pair of subsets whereby players using said subsets from the same separate set may play as partners; side indicia on said gameboard between a receptacle and one of said corner indicia; each of said side indicia being located adjacent said side walls to define a position at which at least one subset of said playing pieces is placed; each receptacle being placed a distance from said walls to define an area between said wall and said receptacle for receiving a playing piece therein; at least one cue piece, each receptacle having means adjacent thereto for defining an area whereby said at least one cue piece may be positioned.

2. Apparatus as recited in claim 1 wherein said game table comprises height adjusting means therefor.

3. Apparatus as recited in claim 2 wherein said height adjusting means comprises supporting legs having a plurality of removable sections.

4. Apparatus as recited in claim 2 wherein said height adjusting means comprises folding legs.

5. Apparatus as recited in claim 1 wherein said side indicia are located at a predetermined location adjacent the perimeter of said surface.

6. Apparatus as recited in claim 1 further comprising penalty areas and indicia for penalty pieces used in playing a game with said apparatus.

7. Apparatus as recited in claim 6 wherein said penalty areas are identical with said side indicia.

* * * * *